United States Patent [19]

Fabrig

[11] Patent Number: 4,729,708

[45] Date of Patent: Mar. 8, 1988

[54] METHOD OF AND APPARATUS FOR TURNING COVER SHEETS OF STATIONERY PRODUCTS

[75] Inventor: Paul Fabrig, Neuffen, Fed. Rep. of Germany

[73] Assignee: Womako Maschinenkonstruktionen GmbH, Nürtingen, Fed. Rep. of Germany

[21] Appl. No.: 12,007

[22] Filed: Feb. 6, 1987

[30] Foreign Application Priority Data

Feb. 19, 1986 [DE] Fed. Rep. of Germany ..... 3605239

[51] Int. Cl.[4] ..... B42B 5/08; B42B 9/02

[52] U.S. Cl. ..... 412/1; 270/53; 270/58; 412/39; 412/7

[58] Field of Search ..... 270/53, 58; 412/1, 7, 412/39; 227/113

[56] References Cited

U.S. PATENT DOCUMENTS 4,161,196 7/1979 Fabrig ..... 140/92.4
4,558,981 12/1985. Fabrig ..... 412/7

FOREIGN PATENT DOCUMENTS 2620688 3/1981 Fed. Rep. of Germany .
2950617 5/1986 Fed. Rep. of Germany .

*Primary Examiner*—Paul A. Bell
*Attorney, Agent, or Firm*—Peter K. Kontler

[57] ABSTRACT

The rear cover sheets of successively bound exercise pads and similar stationary products, wherein the sheets are pivotably held together by a spiral or comb-like binder, are located in front of the front cover sheets immediately following completion of the binding operation. A corner of each rear cover sheet is first lifted off the adjacent outer side of the front cover sheet by a suction cup, and a wedge is inserted betweeen the two cover sheets to form or maintain a gap which is kept open by a strip entering the gap as a result of advancement of the respective pad in parallelism with the axis of its binder in a direction away from the binding station and toward a first turning device having a rod which penetrates into the gap of the oncoming pad and is pivoted to turn the rear cover sheet away from the front cover sheet to an intermediate position on the upper reach of a first endless belt conveyor on which the pads advance in such a way that their partially turned rear cover sheets are located ahead of the respective binders. The turning operation is completed during transfer of successive pads from the first conveyor onto a second endless belt conveyor with assistance from a wheel which is driven to rotate in a direction counter to the travel of the upper reaches of the conveyors.

29 Claims, 3 Drawing Figures

METHOD OF AND APPARATUS FOR TURNING COVER SHEETS OF STATIONERY PRODUCTS

BACKGROUND OF THE INVENTION

The invention relates to the making and processing of stationery and like products of the type wherein sheets of paper and/or other material are held together by a binder for pivotal movement about an axis extending along one edge of the product, such as a calendar, a set of maps, an exercise pad, a book, a brochure, a pamphlet or the like. More particularly, the invention relates to improvements in a method of and in an apparatus for turning one outermost sheet of each of a series of successive stacks of sheets, which are held together by a binder for pivotal movement about a predetermined axis, so that the one outermost sheet is moved away from the adjacent (neighboring) sheet and into contact with the outer side of the other outermost sheet of the respective stack.

Turning of sheets in the just outlined manner is desirable and advantageous in connection with the making of stationery and like products of the type wherein the stack contains two cover sheets and the cover sheets are adjacent each other in the course of the binding operation, e.g., during insertion of a spiral binder or a so-called wire-O (trademark) binder into a row of perforations along one edge of the stack of overlapping sheets. The rear cover sheet overlies the front cover sheet in the course of the binding operation and is thereupon pivoted about the axis of the freshly inserted binder so as to overlie the rearmost sheet of the stack of sheets between the two cover sheets. Such mode of making and processing stationery products which have front and rear cover sheets is desirable and advantageous because the seam which develops at the locus of closing a C-shaped binder in order to convert its prongs into rings can be concealed between the rear cover sheet and the adjacent sheet so that it cannot detract from the appearance of the finished product.

One presently preferred mode of assembling stacked paper sheets with or without cover sheets with binders, particularly wire-O (trademark) binders, is disclosed in commonly owned U.S. Pat. No. 4,558,981 granted Dec. 17, 1985 to Fabrig. The disclosure of this patent is incorporated herein by reference.

The cover sheets of an exercise pad, a brochure, a book or another stationery or like product can be made of a material which is different (in texture, color, thickness, stiffness and/or other characteristics) from the sheets of the stack between the two cover sheets. Many machines for assembling stacked sheets with binders are designed in such a way that two identical or different cover sheets are placed on top of the stack of regular or inner sheets prior to the making of perforations along one edge of the stack but not later than immediately prior to insertion of the binder.

German Auslegeschrift No. 26 20 688 discloses an apparatus which is designed to turn the rear cover sheet of a freshly formed stationery product (e.g., an exercise pad with a stack of paper sheets and two cover sheets which may but need not be made of paper) so that the rear cover sheet is moved from the outer side of the front cover sheet to the outer side of the rearmost paper sheet. The pad which is provided with a freshly inserted binder rests on an inclined plate and is transported from the plate to a turning apparatus including a turning device, an intermediate conveyor and a removing conveyor operating at right angles to the intermediate conveyor. The turning device turns the entire pad from a non-horizontal position which is determined by the aforementioned plate to a horizontal position in which the turned pad comes to rest on the intermediate conveyor. When the turning device completes the turning of the entire pad and is moved back to its starting position, it entrains the rear cover sheet and releases it in a position such that the entrained rear cover sheet is spaced apart from the front cover sheet and hangs by gravity outside of the range of the turning device as soon as it begins to advance with the intermediate conveyor. The pad is thereupon pushed off the intermediate conveyor and onto the removing conveyor in a direction at right angles to the direction of transport of pads on the intermediate conveyor; at such time, the partially turned rear cover sheet is turned again to abut the outer side of the rearmost sheet of the stack of sheets between the two cover sheets.

A drawback of the apparatus which is disclosed in the Auslegeschrift is that turning of the rear cover away from the front cover and against the outer side of the rearmost sheet of the stack in the respective pad necessitates a substantial change of orientation of the entire product (such as a pad), i.e., of a relatively large mass with attendant problems regarding accurate guidance, energy requirements, controlling the inertia of the product and others.

OBJECTS AND SUMMARY OF THE INVENTION

An object of the invention is to provide a relatively simple method of changing the position of the rear cover sheet relative to the front cover sheet in a stationery product wherein the sheets are held together by a binder so that they can turn about a predetermined axis.

Another object of the invention is to provide a method which can be practiced with advantage in connection with the treatment of a wide variety of stationery and like products including books, pamphlets, brochures, pads, calendars, atlantes, reference books and/or others.

A further object of the invention is to provide a method which renders it possible to turn one outermost sheet of a stack of overlapping sheets in a small area, with the consumption of a minimum of energy and in a highly predictable manner.

An additional object of the invention is to provide a novel and improved apparatus for the practice of the above outlined method and to construct and assemble the apparatus in such a way that the major part of each product need not change its orientation at all or requires a minimum of changing for the purpose of turning one outermost sheet away from the neighboring sheet and into abutment with the other outermost sheet.

Another object of the invention is to provide the apparatus with novel and improved means for manipulating that outermost sheet which is to be turned relative to the other sheets.

Still another object of the invention is to provide the apparatus with novel and improved means for transporting and/or otherwise moving the products in the course of the turning operation.

A further object of the invention is to provide the apparatus with novel and improved means for multiple-stage turning of selected outermost sheets of successive products relative to the other sheets.

One feature of the invention resides in the provision of a method of turning one outermost sheet from the outer side of the neighboring sheet to the outer side of the other outermost sheet in a stack of overlapping sheets which are held together by a binder, particularly a wire binder, with freedom of pivotal movement about a predetermined axis which extends along one edge of the stack. The one outermost sheet can constitute the rear cover sheet and the neighboring sheet can constitute the front cover sheet of the ultimate product. The method comprises the steps of moving a portion at least of the one outermost sheet away from the neighboring sheet so as to establish a gap between the one outermost sheet and the neighboring sheet, applying to the one outermost sheet a force in the gap so as to pivot the one outermost sheet relative to the remaining sheets of the stack about the axis of the binder to an intermediate position in which the one outermost sheet is still remote from the other outermost sheet, transporting the stack along a path which extends substantially at right angles to the axis of the binder, and completing the turning of the one outermost sheet against the other outermost sheet in a predetermined portion of the path.

The method can further comprise the step of attaching the binder to the stack substantially immediately prior to the moving step including maintaining the stack in a predetermined orientation. The moving step of such method preferably includes moving the aforementioned portion of the one outermost sheet away from the neighboring sheet while the stack continues to remain in the predetermined orientation. The transporting step of such method can include conveying the stack in such position that the one outermost sheet is located ahead of the axis of the binder.

The moving step can include lifting a corner portion of the one outermost sheet at a location which is remote from the axis of the binder.

The method can further comprise the step of advancing the stack in substantial parallelism with the axis of the binder subsequent to completion of the moving step but prior to the force applying step while the gap between the one outermost sheet and the neighboring sheet of the stack is maintained.

Another feature of the invention resides in the provision of an apparatus for turning one outermost sheet from the outer side of the neighboring sheet to the outer side of the other outermost sheet in a stack of overlapping sheets which are held together by a binder, particularly a wire binder, with freedom of pivotal movement about a predetermined axis which is defined by the binder adjacent one edge of the stack. The apparatus comprises means for supporting the stack in a predetermined orientation such that the one outermost sheet is accessible, means for moving a portion at least of the one outermost sheet relative to the neighboring sheet of the stack on the supporting means so as to establish a gap between the one outermost sheet and the neighboring sheet, first turning means including means for applying to the one outermost sheet a force in the gap so as to pivot the one outermost sheet about the axis of the binder to an intermediate position in which the one outermost sheet is still remote from the other outermost sheet, means for transporting the stack from the first turning means along a predetermined path substantially at right angles to the axis of the binder while maintaining the one outermost sheet in or close to the intermediate position, and second turning means including means for pivoting the one outermost sheet from its intermediate position against the other outermost sheet in a predetermined portion of the path. The transporting means preferably includes means for transporting the stack in such position that the one outermost sheet is located ahead of the axis of the binder. Such transporting means can comprise first and second conveyors, and the second turning means preferably includes a portion at least of at least one of the first and second conyeyors.

The moving means of the improved apparatus can include means for lifting a corner portion of the one outermost sheet of the stack on the supporting means by suction. The moving means of such apparatus can further include a substantially wedge-like member and means for introducing the wedge-like member between the one outermost sheet and the neighboring sheet of the stack on the supporting means upon completion of the lifting operation by suction. The wedge-like member is preferably remote from the axis of the binder of the stack of the supporting means. The introducing means for the wedge-like member can include a lever for the wedge-like member and the means (such as an electromagnet) for pivoting the lever relative to the supporting means.

The force applying means of the first turning means can include a turning member (such as an elongated rod-like member) which is arranged to enter the gap between the one outermost sheet and the neighboring sheet of the stack, and means for displacing the turning member relative to the binder of the stack to thereby pivot the one outermost sheet away from the neighboring sheet. The first turning means can further comprise means for adjustably securing the turning member to the displacing means.

The apparatus can further comprise means for advancing the stack from the moving means to the first turning means, and means for maintaining the gap between the one outermost sheet and the neighboring sheet during advancement of the stack to the first turning means. The maintaining means can include an elongated stationary substantially strip-shaped element. The turning member of the first turning means is preferably movable relative to the stack in or in the advancing means to and from a starting position in which the turning member is aligned with the strip-shaped element.

The apparatus can further comprise carrier means for the maintaining means, and such carrier means can include at least one magnet. A second carrier means can be provided for the moving means, and such second carrier means can include a second magnet. The supporting means preferably includes means for attracting the magnets of the first carrier means and the second carrier means so that the strip-shaped element, the suction lifting means, the wedge-like member and the means for moving the wedge-like member can be mounted on or next to the supporting means in any one of a plurality of different positions, depending upon the size of the sheets in the stack and upon the thickness of the stack. The supporting means can include an elongated table having a surface which is contacted by the outer side of the other outermost sheet of the stack and is inclined relative to the vertical. The advancing means can include means for advancing the stack along the table, and the table can be provided with guide means for such advancing means.

As mentioned before, the transporting means can comprise two conveyors including a first conveyor having an end portion which is remote from the first turning means and forms a first part of the second turning means. The second conveyor of the transporting means is adjacent the end portion of the first conveyor and forms a second part of the second turning means. The second turning means can further comprise means for moving the end portion of the first conveyor up and down, and the stack on the first conveyor is preferably held in such position that the one outermost sheet is located ahead of the binder and is free to pivot downwardly beyond the intermediate position not later than during upward movement of the end portion of the first conveyor. The second turning means can further comprise an additional conveyor which is operative to deflect the one outermost sheet of the stack toward the other outermost sheet not later than when the end portion of the first conveyor completes its downward movement. The first conveyor of the transporting means can include at least one endless conveyor and means for driving the endless conveyor in a predetermined direction. The second turning means preferably further comprises means for driving the additional conveyor (e.g., a drum or wheel) in a second direction counter to the predetermined direction.

The path which is defined by the transporting means is or can be substantially horizontal, and the sheets of the stack on the supporting means are preferably inclined with reference to the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
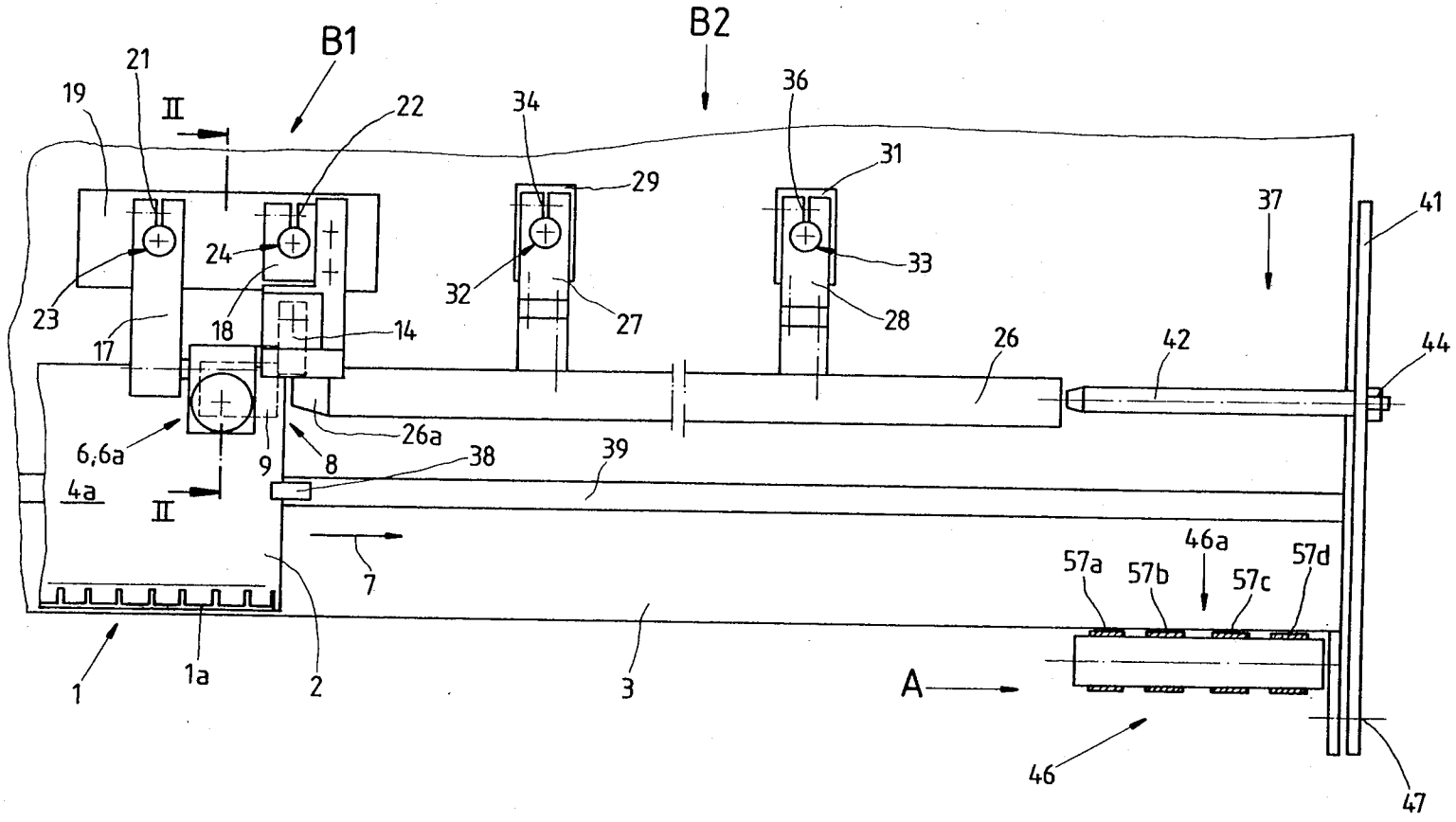
FIG. 1 is a front elevational view of an apparatus which embodies one form of the invention.

The products which are treated in the apparatus of the present invention constitute stacks 2 of overlapping sheets including a first or one outermost sheet 4a which is to constitute the rear cover sheet of the ultimate product, a second or other outermost sheet 4c which is ultimately adjacent the rear cover sheet 4a, and a sheet 4b which is to constitute the upper cover sheet and is adjacent the one outermost sheet 4a prior to turning of the sheet 4a through approximately 180° from the position of abutment with the outer side of the sheet 4b to the position of abutment with the outer side 2a of the other outermost sheet 4c. The sheet 4c as well as all other sheets between the sheet 4c and the sheet 4b can constitute paper sheets, and the product which includes the stack 2 can constitute a book, a pamphlet, a brochure, a catalog, a calendar, an exercise pad or any other stationery or similar product wherein the sheets are held together by a binder so that they can pivot relative to each other about a predetermined axis. FIG. 1 shows a wire-O (trademark) binder 1 of conventional design which defines for the sheets 4a, 4b, 4c and the remaining sheets of the stack 2 an elongated pivot axis 1a adjacent one edge of the stack 2.

The means for supporting the stack 2 during and/or immediately after the last stage of the binding operation (namely introduction of the prongs of the binder 1 into the perforations which are provided in the respective marginal portions of the overlapping sheets of the stack 2) includes a stationary metallic table 3 having an inclined surface 3a which abuts the outer side of the sheet 4c prior to turning of the rear cover sheet 4a from the position of contact with the front cover sheet 4b into the position of contact with the outer side 2a of the sheet 4c. The surface 3a is inclined to the vertical, for example, at an angle of approximately 30°. The binder 1 has a so-called seam where the tips of its curved prongs abut the longitudinally extending rib of the binder, and one of the presently preferred purposes of turning the cover sheet 4a from the position of abutment with the front cover sheet 4b to the position of abutment with the side 2a of the sheet 4c is to conceal the seam of the binder 1 so that the seam cannot adversely affect the appearance of the ultimate product.

The improved apparatus comprises means for moving a selected corner portion 8 of the rear cover sheet 4a away from the adjacent corner portion of the front cover sheet 4b so as to provide room for insertion of a wedge-like member 9 which forms part of the moving means. The moving means further comprises a suction head 6 having a suction cup 6a which can be connected to a suction generating device (not shown) so as to attract the corner portion 8 and to thereby establish a space for introduction of the wedge-like member 9. The suction cup 6a can have an inclined front surface (not specifically shown in FIG. 2) so as to facilitate retention of the rear cover sheet 4a in an optimum position for introduction of the member 9.

The corner portion 8 is one of those two corner portions of the cover sheet 4a which are remote from the binder 1 and its pivot axis 1a. Furthermore, the corner portion 8 is preferably that corner portion which is located ahead of the other upper corner portion as considered in the direction of arrow 7 denoting in FIG. 1 the direction in which the stack 2 is to be advanced along the table 3 from the position shown in FIG. 1 to a position corresponding to that shown in the left-hand portion of FIG. 3.

Figure 2:
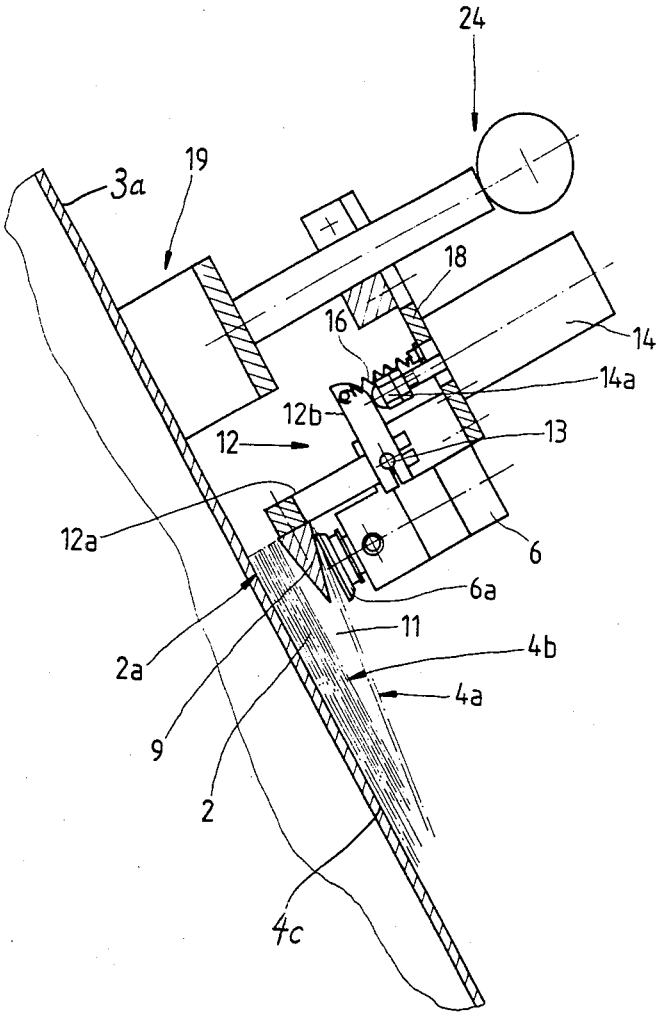
FIG. 2 is sectional view as seen in the direction of arrows from the line II—II of FIG. 1.

The wedge-like member 9 is secured to one arm 12a of a bell-crank lever 12 which is turnable on a pivot member 13 and has a second arm 12b permanently biased by a restoring or retracting coil spring 16 so that the bell-crank lever 12 tends to turn in a clockwise direction, as seen in FIG. 2. The moving means for the rear cover sheet 4a further comprises an electromagnet 14 which constitutes a means for pivoting the lever 12 against the opposition of the spring 16. To this end, the electromagnet 14 comprises a reciprocable armature 14a in the form of a pusher which can engage and turn the arm 12b in a counterclockwise direction, as seen in FIG. 2, so as to cause the spring 16 to store energy simultaneously with propulsion of the wedgelike member on the arm 12a into the rather narrow gap 11 which is established as a result of lifting the corner portion 8 of the cover sheet 4a off the adjacent corner portion of the cover sheet 4b. The lever 12 is remote from the binder 1 and causes the wedge-like member 9 to penetrate into the gap 11 along that edge of the stack 2 which is remote from and parallel to the pivot axis 1a defined by the binder 1. Such penetration takes place while the stack 12 dwells in the position which is shown in the left-hand portion of FIG. 1.

The electromagnet 14 can be caused to change its condition as soon as or shortly after the stack 2 on the table 3 is set in motion in the direction which is indicated by the arrow 7. At such time, the armature 14*a* is retracted and the spring 16 is free to pivot the lever 12 in a clockwise direction (as seen in FIG. 2) in order to extract the wedge-like member 9 from the widest portion of the gap 11 at a location which is remote from the binder 1.

The moving means including the suction head 6, the wedge-like member 9, the lever 12 and the means for pivoting the lever 12 (including the spring 16 and the electromagnet 14) are preferably adjustably mounted on a carrier including a permanent magnet 19 which can be attracted by the table 3 so as to be held in a preselected position. The magnet 19 comprises or carries two spaced-apart parallel rod-like members 23, 24 for plate-like holders 17, 18 which directly or indirectly carry the parts 6, 9, 12, 14 and 16 of the moving means. The holders 17 and 18 are provided with clamping devices 21, 22 which releasably and adjustably secure them to the respective rod-like members 23 and 24. This enables an operator to select the distance between the suction cup 6*a* and the wedge-like member 9 on the one hand and the surface 3*a* of the table 3 on the other hand in order to properly position the moving means for the corner portion 8 of the cover sheet 4*a* in dependency upon the dimensions of the sheets and/or the thickness of the stack 2 on the table 3. The rods 23 and 24 extend at right angles to the plane of the surface 3*a* on the table 3. This can be readily seen in FIG. 2. The clamping devices 21, 22 are preferably designed to allow for rapid loosening or tightening so as to permit rapid adjustment of the holders 17 and 18 in directions at right angles to the surface 3*a* of the table 3. The exact construction of the clamping devices 21 and 22 forms no part of the present invention. It is further clear that the carrier including the magnet 19 can be replaced with other types of carrier means without departing from the spirit of the invention. A magnet is preferred at this time because it can reliably hold the moving means 6, 9, 12, 14, 16 on a selected portion of the table 3 without necessitating the application or loosening of screws, nuts, bolts or like fastener means. The parts 6, 9, 12–14, 16–19 and 21–24 can be said to jointly constitute a first unit B1 which is attachable to or detachable from the table 3 in a simple and time-saving operation. The unit B1 can be installed in certain types of existing machines for the making of stationery products and the like in the form of pads, booklets, brochures and the like so that such machines can be converted for the practice of the method of the present invention.

In accordance with a further (optional) feature of the invention, the improved apparatus comprises an elongated stationary strip-shaped member 26 which constitutes a means for temporarily maintaining the gap 11 between the cover sheets 4*a* and 4b while the stack 2 is being advanced in the direction of the arrow 7 from the position which is shown in FIG. 1 into the range of a first turning device 37 for the cover sheet 4*a*. The strip-shaped member 26 is parallel with the direction which is indicated by the arrow 7 and with the axis 1*a* of the binder 1 for the stack 2. The means for releasably securing the strip-shaped member 26 to the table 3 comprises a plurality of preferably plate- or strip-shaped holders 27, 28 which are separably secured to rods 32, 33 on discrete magnets 29, 31 by clamping devices 34, 36, respectively. The construction of the clamping devices 34, 36 can be identical or similar to that of the clamping devices 21, 22. The parts 26–29, 31–34 and 36 together constitute a second unit B2 which can be separably secured to the table 3 adjacent the unit B1 in a manner as shown in FIG. 1. The adjustability of holders 27, 28 longitudinally of the respective rods 32, 33 renders it possible to place the strip-shaped member 26 at a selected distance from the surface 3*a* of the table 3, namely at a distance which is a function of the distance of the gap 11 in a stack 2 from the surface 3*a*. This enables the apparatus to readily manipulate a wide variety of thick, thin or medium thin stacks with large, medium-sized or small sheets. As mentioned above, the purpose of the strip-shaped member 26 is to maintain the gap 11 between the cover sheets 4*a* and 4*b* while the stack 2 is being advanced from the unit B1 toward and into the range of the first turning device 37 for the cover sheet 4*a*. The left-hand end portion 26*a* of the strip-shaped member 26 (as seen in FIG. 1) preferably resembles or constitutes a wedge so that it can readily penetrate into the oncoming front end of the gap 11 while the stack 2 is being advanced in the direction of arrow 7.

The means for advancing the stack 2 along the surface 3*a* of the table 3 comprises a plurality of entraining elements 38 in the form of pushers which are movable in a guide channel 39 of the table 3 in the direction of the arrow 7 and are mounted on an endless chain or belt (not shown) in such a way that they enter the guide channel 39 at the left-hand end of the table 3 (as seen in FIG. 1) and descend below the surface 3*a* when the fully advanced stack 2 reaches the first turning device 37. Each of the entraining elements 38 can constitute tongs, for example, of the type disclosed in the assignee's German Pat. No. 29 50 617. Other types of entraining elements, for example, of the type disclosed in assignee's U.S. Pat. No. 4,161,196 granted July 17, 1979 to Fabrig can be used with equal or similar advantage.

Figure 3:
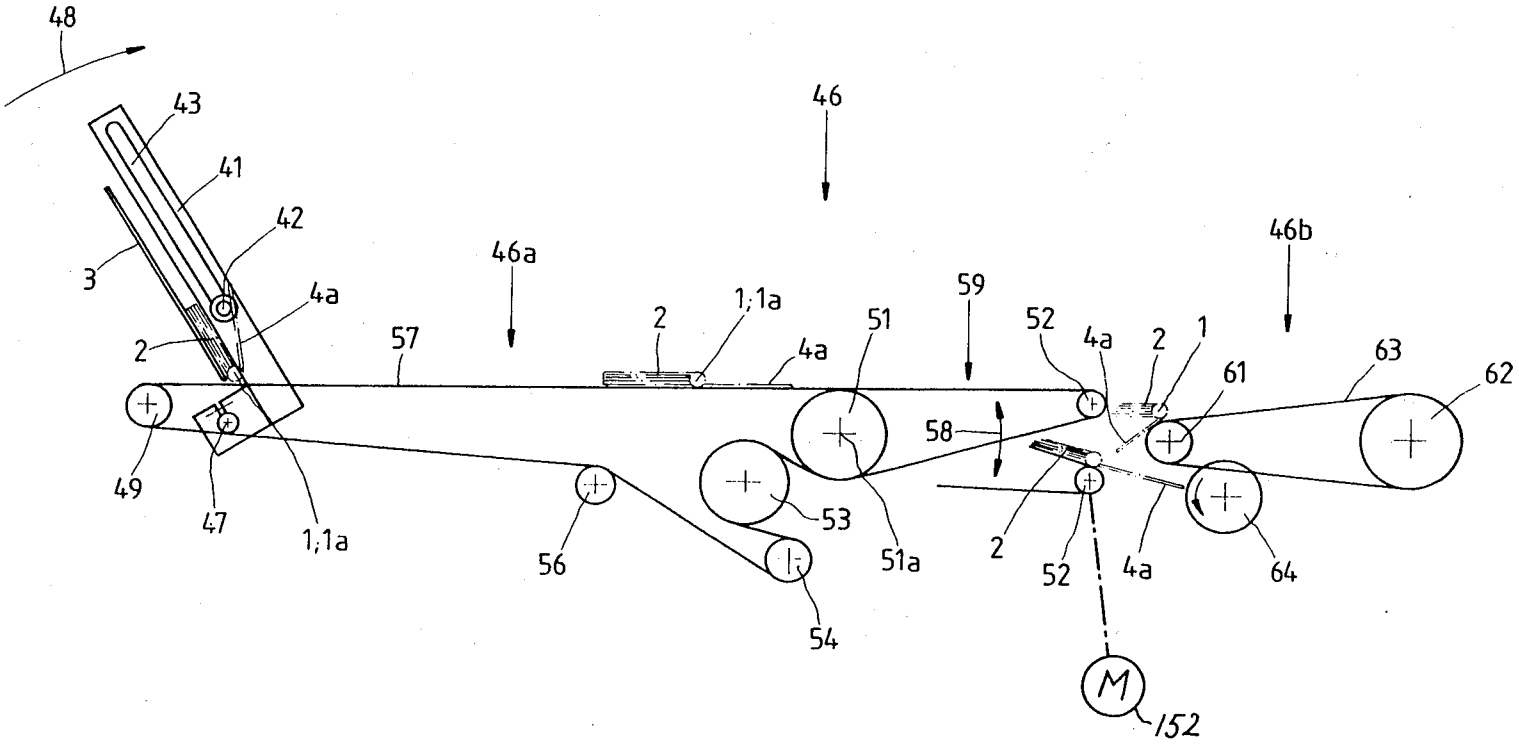
FIG. 3 is a side elevational view of the transporting means as seen in the direction of arrow A in FIG. 1.

The details of the first turning device 37 are shown in the right-hand portion of FIG. 1 and in the left-hand portion of FIG. 3. This device comprises an elongated rod-shaped turning member 42 which is movable to and from a position of axial alignment with the stationary strip-shaped member 26 so as to penetrate into the gap 11 between the cover sheets 4*a* and 4*b* of the oncoming stack 2. the turning member 42 is mounted on a pivotable displacing lever 41 and is adjustable in the longitudinal direction of this lever so as to ensure that it can be moved to and from a position of accurate alignment with the strip-shaped member 26. To this end, the lever 41 has an elongated slot 43 for the respective end portion of the turning member 42, and the member 42 can be secured to the lever 41 at a selected distance from the pivot member 47 for the lever 41 by suitable fastener means, such as a nut 44 which mates with the externally threaded end portion of the turning member 42.

When a stack 2 has been advanced into the range of the first turning device 37, i.e., when the turning member 42 has entered the gap 11 between the cover sheets 4*a* and 4*b* of such stack, the entraining elements 38 are disengaged from the stack and the lever 41 is caused to move the turning member 42 along an arcuate path (see the arrow 48 in FIG. 3) so as to turn the cover sheet 4*a* in a clockwise direction, as seen in FIG. 3, and away from the other cover sheet 4*b*. At such time, the orientation of the stack 2 on the surface 3*a* of the table 3 remains unchanged. The turning member 42 pivots the cover sheet 4a about the axis 1a of the binder 1 and onto the upper side of the upper reach of a composite endless belt 57 forming part of a first conveyor 46a which, in turn, forms part of a transporting device 46 serving to advance the stack 2 and its cover sheet 4a at right angles to the axis 1a of the binder 1 as soon as the pivoting of the cover sheet 4a from a substantially upright position shown in the left-hand portion of FIG. 3 to a substantially horizontal intermediate position on the upper reach of the endless belt 57 is completed. The stack 2 descends onto the belt 57 and advances in a direction to the right, as seen in FIG. 3 in such position that the cover sheet 4a is located ahead of the axis 1a of the binder 1 which pivotally connects the sheets of the stack 2 to each other.

The transporting device 46 further comprises a second conveyor 46b which is located downstream of the conveyor 46a, as seen in the direction of transport of stacks 2 by the endless belt 57. The latter can comprise a plurality of relatively narrow belts 57a, 57b, 57c and 57d (see the right-hand portion of FIG. 1) which are disposed in parallel vertical planes. The belt 57 is trained over a plurality of pulleys including those numbered 49, 51, 52, 53, 54 and 56. At least one of these pulleys (for example, the pulley 53) is driven by a suitable motor (not shown) or by a transmission so as to advance the upper reach of the belt 57 in a direction to the right, as seen in FIG. 3.

The front end portion 59 of the first conveyor 46a is pivotable about the axis 51a of the pulley 51, between the two end positions which are shown in FIG. 3, by a suitable reversible motor M or by any other means capable of causing the portion of the upper reach of the belt 57 between the pulleys 51 and 52 to assume a substantially horizontal position or a position in which it is inclined to the horizontal through an angle of approximately 15 or 20 degrees. The extent of inclination will be selected in dependency on the nature of the belt 57 and upon the smoothness of sheets forming part of the stack 2. The directions in which the front end portion 59 of the first conveyor 46a is pivotable about the axis 51a are indicated by the double-headed arrow 58.

The second conveyor 46b of the transporting device 46 comprises at least one endless belt 63 which is trained over pulleys 61 and 62. At least one of these pulleys is driven in a manner not specifically shown in the drawing. The end portion 59 of the conveyor 46a, the second conveyor 46b and a roller- or drum-shaped additional conveyor 64 can be said to constitute a second turning device which completes the turning of the cover sheet 4a from the intermediate position shown in the central portion of FIG. 3 to a final position of abutment with the outer side 2a of the sheet 4c in the respective stack 2. The additional conveyor 64 is driven by a motor or the like (not shown) in a counterclockwise direction, i.e., counter to the direction of travel of the upper reaches of the belts 57 and 63. This additional conveyor is located in such position that it can engage and deflect the front edge of the cover sheet 4a after the respective stack 2 has reached the front end portion 59 of the first conveyor 46a and has descended, together with such front end portion, to the lower position of FIG. 3. This enables the cover sheet 4a to move closer to its final position, and the turning of the cover sheet 4a continues in response to lifting of the front end portion 59 from the lower position to the upper position and in response to subsequent transfer of the stack 2 from the conveyor 46a onto the conveyor 46b. As the stack 2 reaches and comes to rest on the upper reach of the belt 63, the turning of the cover sheet 4a from its intermediate position to its final position is completed so that the conveyor 46b can transport the stack to storage, to a packing machine or to another destination.

It is clear that the belt 63 can also comprise several discrete narrower belts which are disposed in parallel vertical planes, not unlike the narrower belts 57a–57d of the belt 57 forming part of the first conveyor 46a.

The apparatus of FIGS. 1–3 can be modified in a number of ways without departing from the spirit of the invention. For example, the strip-shaped member 26 can be omitted if the rod-like turning member 42 of the first turning device 37 is lengthened in a direction toward the unit B1 of FIG. 1 or if the station for the moving means 6, 9, 12, 14, 16 is placed nearer to the first turning device 37. This results in substantial savings in space which may be desirable or necessary in a particular production line.

The means for synchronizing the operation of the electromagnet 14 with the operation of the means for pivoting the lever 41 for the turning member 42, for moving the entraining elements 38, for driving the conveyors of the transporting device 46, (motor 152) for pivoting the front end portion 59 of the conveyor 46a and for driving the additional conveyor 64 is not specifically shown in the drawing. Such synchronizing means can be of any conventional design and is preferably designed in such a way that the apparatus can treat a succession of stacks 2 at a frequency which is necessary to process stacks at the rate at which they are provided with discrete binders 1 or with analogous binders.

It is further clear that the means for moving a portion of the cover sheet 4a away from the cover sheet 4b on the table 3 can be designed to simultaneously lift two or three selected portions of the cover sheet 4a so as to further ensure the establishment of a gap 11 having a desired width. For example, the moving means can comprise two suction cups 6a, one for each of the two (upper) corner portions which are remote from the binder 1. As can be seen in the drawing, the moving means is designed so as to pivot the cover sheet 4a forwardly and away from the inclined surface 3a of the table 3. The turning member 42 of the first turning device 37 is also designed to pivot the cover sheet 4a forwardly and away from the surface 3a of the table 3. The second turning means (including the end portion 59 of the conveyor 46a, the conveyor 46b and the additional conveyor 64) can be replaced with other types of means for completing the turning of the cover sheet 4a to its ultimate position of abutment with the sheet 4c without departing from the spirit of the invention. The illustrated second turning means has been found to be simple, compact and effective.

An important advantage of the improved method and apparatus is that the turning of the cover sheet 4a can begin while the respective stack 2 is still held in the position corresponding to that during or following the last stage of application of the binder 1 or an analogous binder.

Another important advantage of the improved method and apparatus is that it is not necessary to turn, tilt or pivot the entire stack 2 for the sole purpose of turning the cover sheet 4a away from the other cover sheet 4b and against the sheet 4c of the respective stack. The stack 2 can remain in contact with the surface 3a of the table 3 during a substantial part of the turning operation which involves pivoting the cover sheet 4a relative to the other sheets of the respective stack. The just discussed feature of turning the cover sheet 4a relative to the remaining sheets of the stack instead of turning or pivoting the entire stack, is desirable and advantageous because relatively small masses must be turned or pivoted for the purpose of changing the position of the cover sheet 4a. This contributes to a gentler treatment of the stacks so that they are less likely to be damaged, defaced or have their sheets shifted during transport along the table 3 and on the transporting device 46. The aforementioned intermediate conveyor of conventional sheet turning apparatus can be dispensed with.

A further important advantage of the improved apparatus is its versatility. Thus, the apparatus can be readily adjusted so as to treat thicker or thinner stacks having larger or smaller sheets. Such adjustment takes up little time and can be carried out even by semiskilled persons. Furthermore, the operation of the entire apparatus including adjustment of various parts so as to conform to the format of stacks can be carried out automatically by a suitable programming device, not shown. Still further, the improved apparatus or certain parts of such apparatus can be installed in existing production lines for stationery or like products of the type wherein stacks of sheets are held together for pivotal movement by wire-O (trademark) binders or the like. If a conventional production line already comprises an inclined table 3, the remaining parts of the improved apparatus can be installed adjacent such table so as to enable the table to form part of the improved apparatus. In other words, existing production lines can be readily converted to embody apparatus, or to convert certain parts thereof into parts of apparatus, which operate in accordance with the method of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of turning one outermost sheet from the outer side of the neighboring sheet to the outer side of the other outermost sheet in a stack of overlapping sheets which are held together by a binder, particularly a wire binder, with freedom of pivotal movement about a predetermined axis, comprising the steps of moving a portion at least of the one outermost sheet away from the neighboring sheet so as to establish a gap therebetween; applying to the one outermost sheet a force in the gap so as to pivot the one outermost sheet relative to the remaining sheets of the stack about said axis to an intermediate position still remote from the other outermost sheet; transporting the stack along a path extending substantially at right angles to the axis; and completing the turning of the one outermost sheet against the other outermost sheet in a predetermined portion of said path.

2. The method of claim 1, further comprising the step of attaching the binder to the stack substantially immediately prior to said moving step, including maintaining the stack in a predetermined orientation, said moving step including moving said portion of the one outermost sheet away from the neighboring sheet while the stack continues to assume said predetermined orientation, said transporting step including conveying the stack in such position that the one outermost sheet is located ahead of said axis.

3. The method of claim 1, wherein said moving step includes lifting a corner portion of the one outermost sheet at a location which is remote from said axis.

4. The method of claim 1, further comprising the step of advancing the stack in substantial parallelism with said axis subsequent to said moving step and prior to said force applying step while maintaining the gap between the one outermost sheet and the neighboring sheet of the stack.

5. Apparatus for turning one outermost sheet from the outer side of the neighboring sheet to the outer side of the other outermost sheet in a stack of overlapping sheets which are held together by a binder, particularly a wire binder, with freedom of pivotal movement about a predetermined axis, comprising means for supporting the stack in a predetermined orientation such that the one outermost sheet is accessible; means for moving a portion at least of the one outermost sheet relative to the neighboring sheet of the stack on said supporting means so as to establish a gap between the one outermost sheet and the neighboring sheet; first turning means including means for applying to the one outermost sheet a force in said gap so as to pivot the one outermost sheet about said axis to an intermediate position still remote from the other outermost sheet; means for transporting the stack from said first turning means along a predetermined path substantially at right angles to said axis while maintaining the one outermost sheet in or close to said intermediate position; and second turning means including means for pivoting the one outermost sheet from said intermediate position against the other outermost sheet in a predetermined portion of said path.

6. The apparatus of claim 5, wherein said transporting means includes means for transporting the stack in such position that the one outermost sheet is located ahead of said axis.

7. The apparatus of claim 5, wherein said transporting means comprises first and second conveyors, said second turning means including a portion at least of at least one of said conveyors.

8. The apparatus of claim 5, wherein said moving means includes means for lifting a corner portion of the one outermost sheet of the stack on said supporting means by suction.

9. The apparatus of claim 5, wherein said moving means includes a substantially wedge-like member and means for introducing said member between the one outermost sheet and the neighboring sheet of the stack on said supporting means.

10. The apparatus of claim 9, wherein said wedge-like member is remote from the axis of the binder of the stack on said supporting means.

11. The apparatus of claim 9, wherein said introducing means includes a lever for said member and means for pivoting said lever relative to said supporting means.

12. The apparatus of claim 11, wherein said pivoting means comprises an electromagnet.

13. The apparatus of claim 5, wherein said force applying means comprises a turning member arranged to enter the gap between the one outermost sheet and the neighboring sheet of the stack, and means for displacing said turning member relative to the binder of the stack to thereby pivot the one outermost sheet away from the neighboring sheet.

14. The apparatus of claim 13, wherein said turning member includes an elongated rod-like member.

15. The apparatus of claim 13, wherein said first turning means further comrises means for adjustably securing said turning member to said displacing means.

16. The apparatus of claim 5, wherein said moving means includes means for lifting a corner portion of the one outermost sheet of the stack on said supporting means, a substantially wedge-like member, means for introducing said member between the one outermost sheet and the neighboring sheet of the stack on said supporting means, and a common carrier for said lifting means, said wedge-like member and said introducing means.

17. The apparatus of claim 16, wherein said common carrier includes magnet means connectable to and separable from said supporting means.

18. The apparatus of claim 5, further comprising means for advancing the stack from said moving means to said first turning means and means for maintaining the gap between the one outermost sheet and the neighboring sheet during advancement of the stack to said first turning means.

19. The apparatus of claim 18, wherein said maintaining means includes an elongated stationary substantially strip-shaped element.

20. The apparatus of claim 19, wherein said force applying means comprises a turning member movable relative to the stack on said advancing means to and from a starting position in which said turning member is aligned with said strip-shaped element.

21. The apparatus of claim 18, further comprising carrier means for said maintaining means, said carrier means including at least one magnet.

22. The apparatus of claim 21, further comprising second carrier means for said moving means, said second carrier means including a second magnet and said supporting means including means for attracting said magnets.

23. The apparatus of claim 22, wherein said supporting means includes an elongated table having a surface which is contacted by the outer side of the other outermost sheet of the stack and is inclined relative to the vertical.

24. The apparatus of claim 18, wherein said supporting means includes a table and said advancing means includes means for advancing the stack along said table.

25. The apparatus of claim 24, wherein said table includes guide means for said advancing means.

26. The apparatus of claim 5, wherein said transporting means comprises a first conveyor having an end portion remote from said first turning means and forming a first part of said second turning means, said transporting means further comprising a second conveyor adjacent the end portion of said first conveyor and forming a second part of said second turning means, said second turning means further comprising means for moving the end portion of said first conveyor up and down, the stack on said first conveyor being held in such position that the one outermost sheet is located ahead of the binder and is free to pivot downwardly beyond the intermediate position thereof not later than during upward movement of the end portion of said first conveyor.

27. The apparatus of claim 26, wherein said second turning means further comprises an additional conveyor which is operative to deflect the one outermost sheet of the stack toward the other outermost sheet not later than when the end portion of said first conveyor completes its downward movement.

28. The apparatus of claim 27, wherein said first conveyor includes at least one endless conveyor and means for driving said endless conveyor in a predetermined direction, said second turning means further comprising means for driving said additional conveyor in a second direction counter to said predetermined direction.

29. The apparatus of claim 5, wherein said path is substantially horizontal and the sheets of the stack on said supporting means are inclined with reference to said path.

* * * * *